US005923255A

United States Patent [19]

Vahdatshoar

[11] Patent Number: 5,923,255

[45] Date of Patent: Jul. 13, 1999

[54] CHILD DANGER SIGNALING DEVICE

[76] Inventor: Fraidoon Vahdatshoar, 1023 Windyhill Rd., Fairview Village, Pa. 19403

[21] Appl. No.: 08/870,058

[22] Filed: Jun. 5, 1997

[51] Int. Cl.[6] ..... G08B 23/00

[52] U.S. Cl. ..... 340/573.4; 340/573.1

[58] Field of Search ..... 340/573, 691, 340/692, 693, 539; 320/2, 3, 4, 20

[56] References Cited

U.S. PATENT DOCUMENTS

| | | | |
|---|---|---|---|
| 4,092,580 | 5/1978 | Prinsze | 320/2 |
| 4,843,336 | 6/1989 | Kuo | 340/521 |
| 4,884,059 | 11/1989 | Shapiro | 340/514 |
| 4,884,060 | 11/1989 | Shapiro | 340/514 |
| 4,899,135 | 2/1990 | Ghahariiran | 340/573 |
| 5,001,462 | 3/1991 | Seemann et al. | 340/574 |
| 5,005,002 | 4/1991 | Halperin | 340/574 |
| 5,025,247 | 6/1991 | Banks | 340/574 |
| 5,115,223 | 5/1992 | Moody | 340/573 |
| 5,274,358 | 12/1993 | Janis | 340/574 |
| 5,317,305 | 5/1994 | Campman | 340/573 |
| 5,349,340 | 9/1994 | Blumenthal | 340/691 |
| 5,420,570 | 5/1995 | Leitten et al. | 340/574 |
| 5,450,064 | 9/1995 | Williams, Jr. et al. | 340/574 |
| 5,475,368 | 12/1995 | Collins | 340/573 |
| 5,517,180 | 5/1996 | Masi et al. | 340/573 |
| 5,521,582 | 5/1996 | Kingston | 340/539 |
| 5,523,740 | 6/1996 | Burgmann | 340/573 |
| 5,541,579 | 7/1996 | Kiernan | 340/573 |
| 5,587,704 | 12/1996 | Foster | 340/573 |
| 5,617,075 | 4/1997 | Worth et al. | 340/574 |
| 5,635,908 | 6/1997 | Soper | 340/574 |
| 5,644,296 | 7/1997 | Miller | 340/573 |
| 5,689,240 | 11/1997 | Traxler | 340/573 |
| 5,731,759 | 3/1998 | Finucan | 340/628 |

*Primary Examiner*—Jeffery A. Hofsass
*Assistant Examiner*—Toan N. Pham

[57] ABSTRACT

A new child danger signaling device for alerting guardians when a child presses a danger switch. The inventive device includes a transmitter worn by a child and a receiver carried by the parent with an attached key for disarming the transmitter.

1 Claim, 5 Drawing Sheets

FIG 7
CHILD UNIT
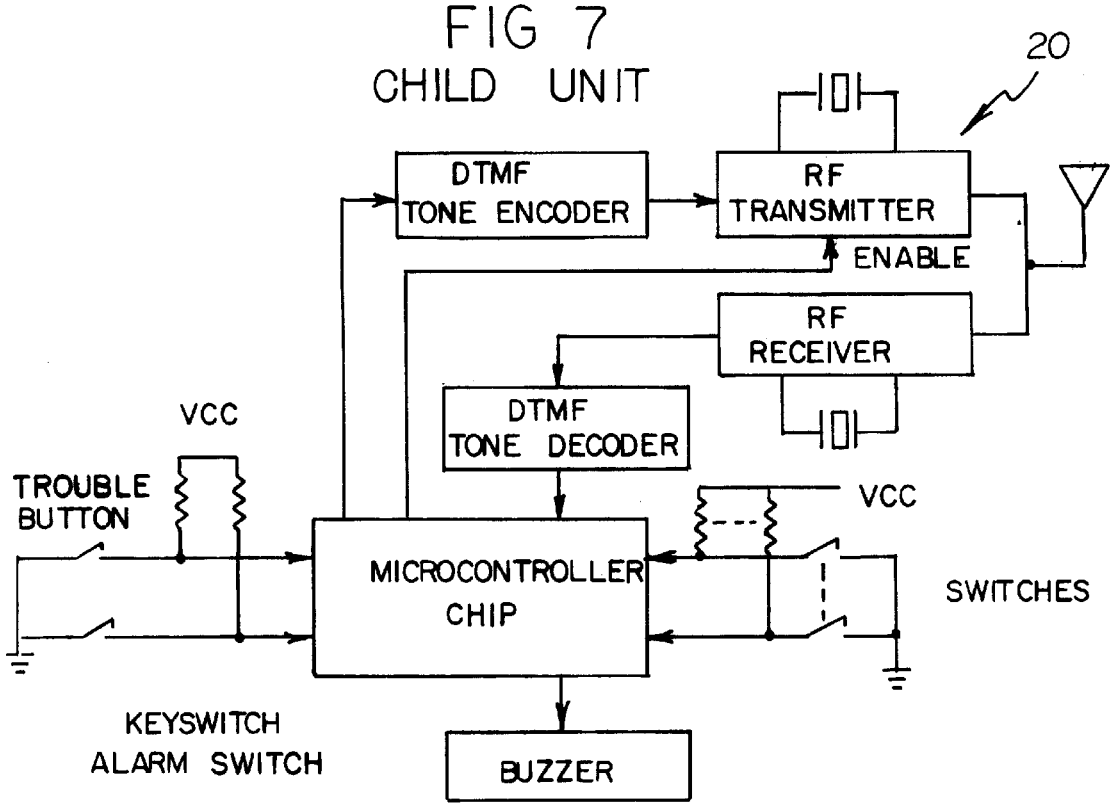
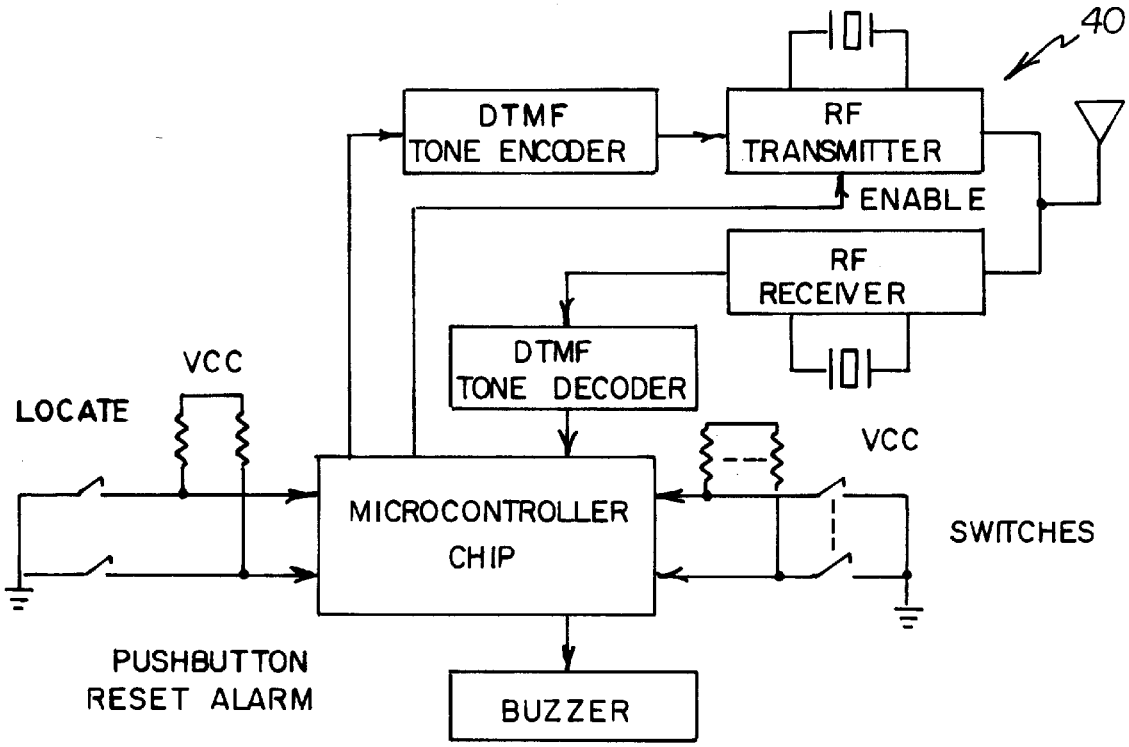
FIG 8
PARENTAL UNIT

FIG 9
CHARGING CIRCUIT
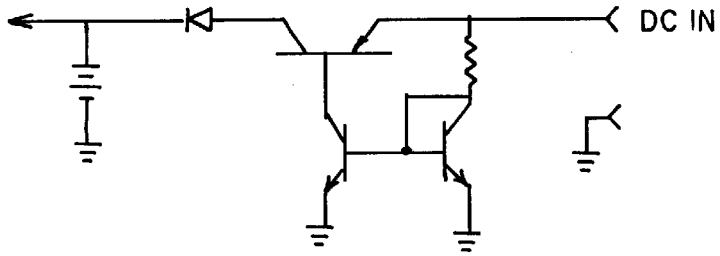
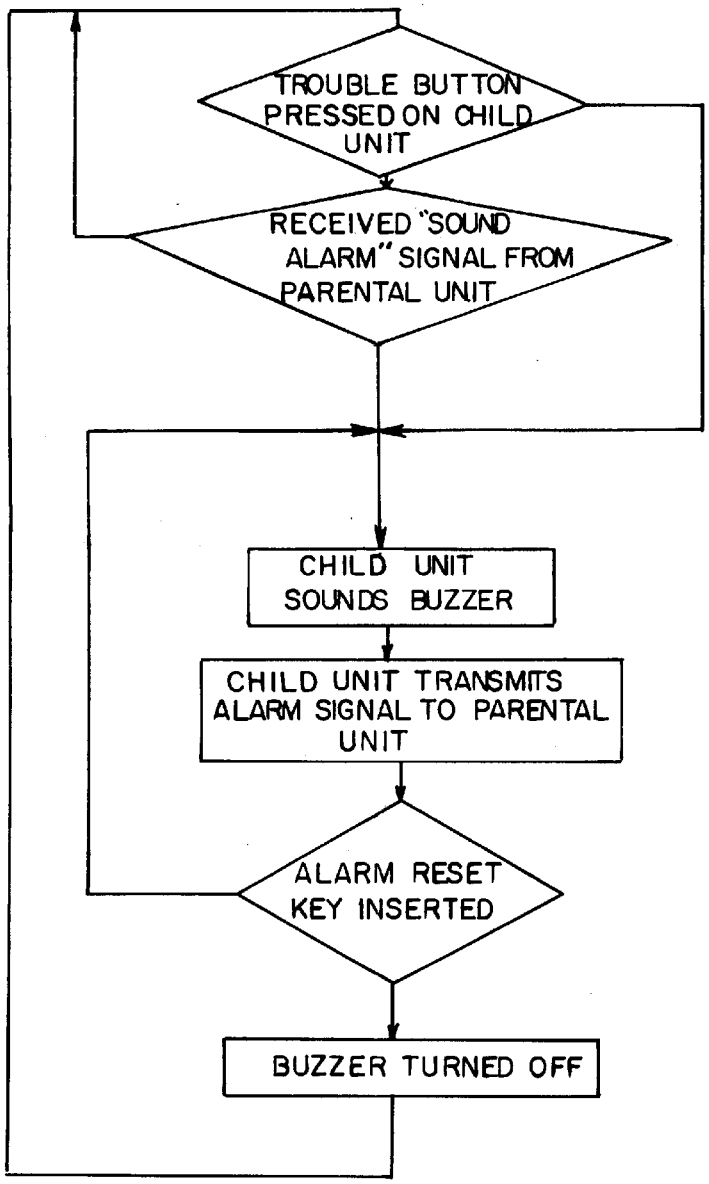
FIG 10

CHILD DANGER SIGNALING DEVICE

BACKGROUND OF THE INVENTION

1. Field of the Invention

The present invention relates to child monitoring devices and more particularly pertains to a new child danger signaling device for alerting guardians when children press a danger button.

2. Description of the Prior Art

The use of child monitoring devices is known in the prior art. More specifically, child monitoring devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art child monitoring devices include U.S. Pat. No. 4,899,135. U.S. Pat. No. 5,021,794 Lawrence and U.S. Pat. No. 343,367 relate to personal emergency locator systems. U.S. Pat. No. 5,119,072 relates to voice monitoring and range monitoring. U.S. Pat. No. 4,888,580 relates to magnet activated child abduction alarm. U.S. Pat. No. 5,423,574 relates to identifier tagging systems for child loss prevention.

While these devices fulfill their respective, particular objectives and requirements, the aforementioned patents do not disclose a new child danger signaling device. The inventive device includes a child worn transmitter and a guardian carried receiver with attached key. The inventive device provides a system that warn a guardian who carries the receiver when the child recognizes danger. The system also provides multiple alarms. The transmitter sounds an audible warning signal to persons surrounding the child. A remote audible and visual signal is given to the guardian who had the receiver. Only the key attached to the receiver can reset In these respects, the child danger signaling device according to the present invention substantially departs from the conventional concepts and designs of the prior art, and in so doing provides an apparatus primarily developed for the purpose of alerting guardians when children press a danger button.

SUMMARY OF THE INVENTION

In view of the foregoing disadvantages inherent in the known types of child monitoring devices now present in the prior art, the present invention provides a new child danger signaling device construction wherein the same can be utilized for alerting guardians when children press a danger button.

The general purpose of the present invention, which will be described subsequently in greater detail, is to provide a new child danger signaling device apparatus and method which has many of the advantages of the child monitoring devices mentioned heretofore and many novel features that result in a new child danger signaling device which is not anticipated, rendered obvious, suggested, or even implied by any of the prior art child monitoring devices, either alone or in any combination thereof.

To attain this, the present invention generally comprises a child worn transmitter and a parent carried receiver with attached key.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new child danger signaling device apparatus and method which has many of the advantages of the child monitoring devices mentioned heretofore and many novel features that result in a new child danger signaling device which is not anticipated, rendered obvious, suggested, or even implied by any of the prior art child monitoring devices , either alone or in any combination thereof.

It is another object of the present invention to provide a new child danger signaling device which may be easily and efficiently manufactured and marketed.

It is a further object of the present invention to provide a new child danger signaling device which is of a durable and reliable construction.

An even further object of the present invention is to provide a new child danger signaling device which is susceptible of a low cost of manufacture with regard to both materials and labor, and which accordingly is then susceptible of low prices of sale to the consuming public, thereby making such child danger signaling device economically available to the buying public.

Still yet another object of the present invention is to provide a new child danger signaling device which provides in the apparatuses and methods of the prior art some of the advantages thereof, while simultaneously overcoming some of the disadvantages normally associated therewith.

Still another object of the present invention is to provide a new child danger signaling device for alerting guardians when children press a danger button.

Yet another object of the present invention is to provide a new child danger signaling device which includes a child worn transmitter and a parent carried receiver with attached key.

Still yet another object of the present invention is to provide a new child danger signaling device that has a key lock that is the only means to turn off the audio alarm that is in the child's transmitter.

Even still another object of the present invention is to provide a new child danger signaling device that has a key attached to a guardian's receiver.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a schematic illustration of the transmitter comprising conventional circuitry.

FIG. 8 is a schematic illustration of the receiver comprising conventional circuitry.

FIG. 9 is a schematic illustration of the recharging unit comprising conventional circuitry.

FIG. 10 is an example flowchart of one feature of the present invention.

DESCRIPTION OF THE PREFERRED EMBODIMENT

Figure 1:
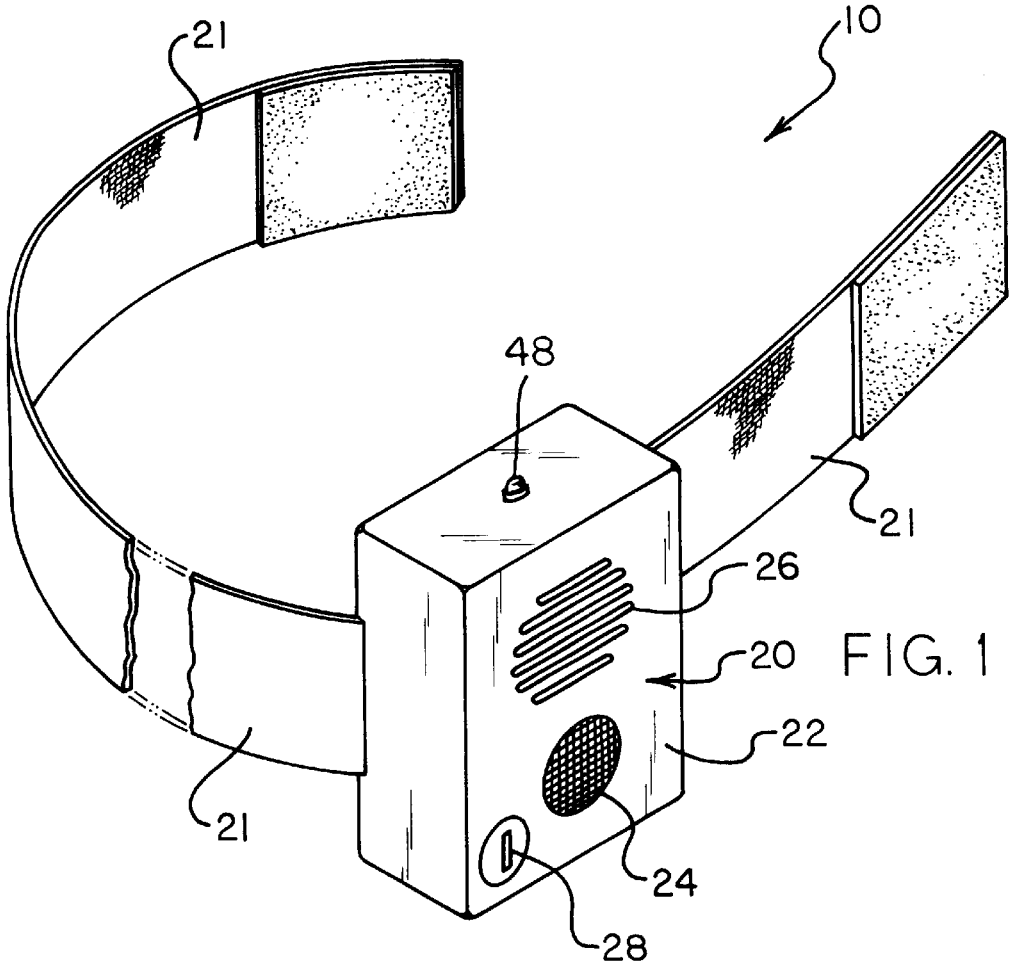
FIG. 1 is a right side perspective view of a first embodiment of a new child danger signaling device child's transmitter according to the present invention.
Figure 2:
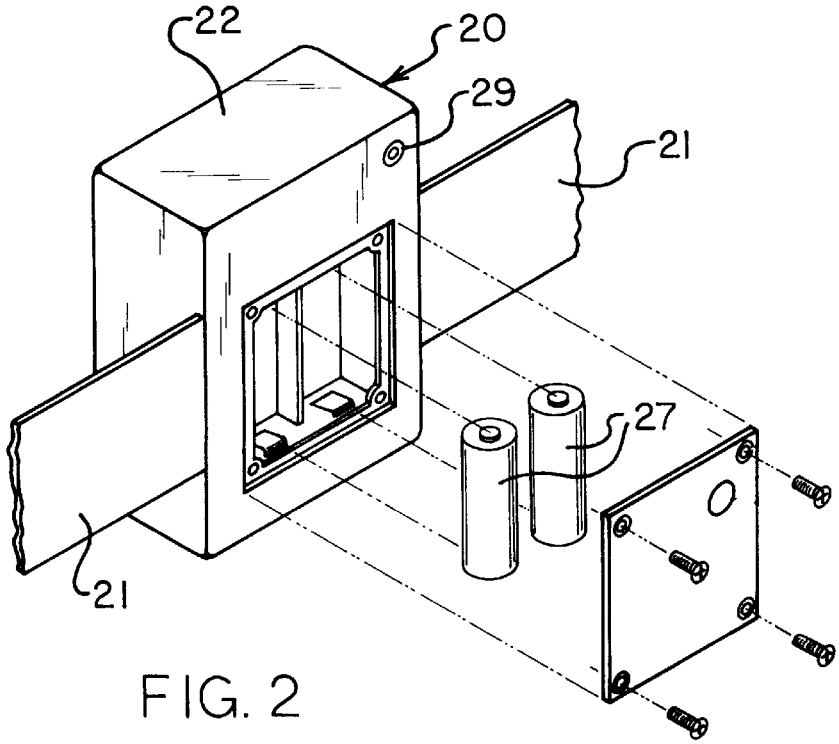
FIG. 2 is a left side perspective view thereof.

With reference now to the drawings, and in particular to FIGS. 1 through 10 thereof, a new child danger signaling device embodying the principles and concepts of the present invention and generally designated by the reference numeral 10 will be described.

Figure 6:
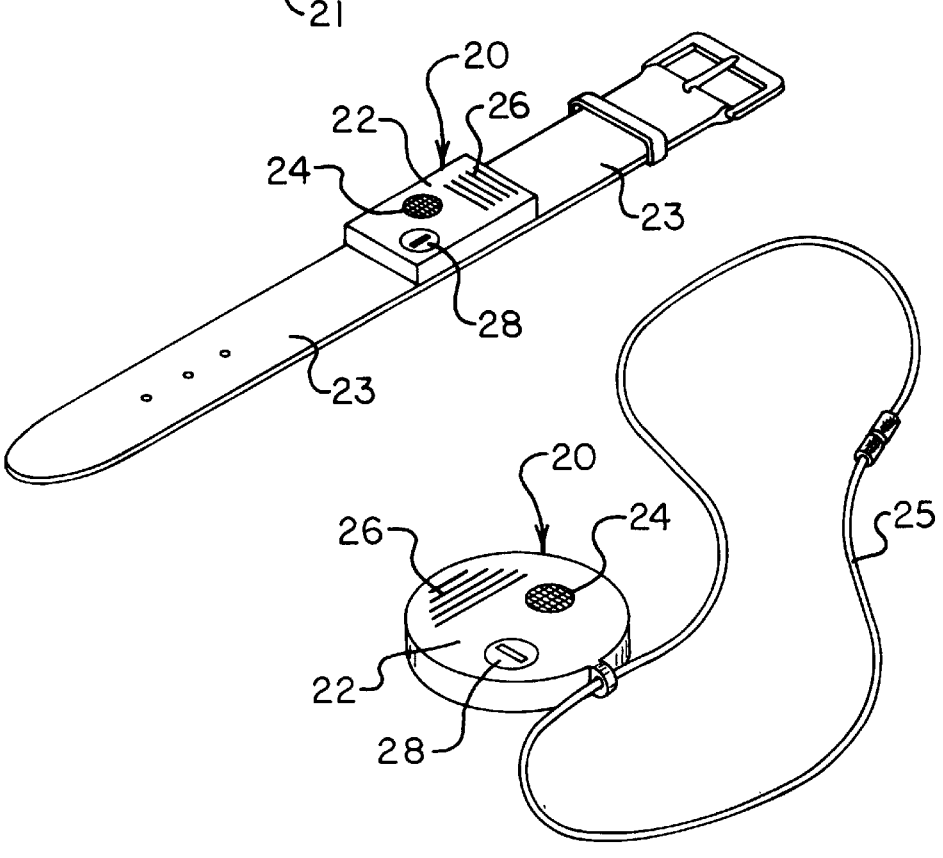
FIG. 6 is an upper perspective view of a second and third embodiment of a new child danger signaling device child transmitter according to the present invention.

More specifically, it will be noted that the child danger signaling device 10 comprises a transmitter 20 having a swaged encasement 22 and capable of transmitting a signal upon a depression of a switch 24, and a receiver 40 having a rectangular encasement 42 capable of detecting the signal, whereupon detecting the signal an alarm 46 is activated thereby notifying the parent that the child is in danger. As shown in FIGS. 1 and 6 of the drawings, the transmitter 20 includes a speaker 26 which emits an audible sound upon depression of the switch 24. Optionally, this sound may be a pre-programmed voice that sounds "help" or other words when the alarm 46 is activated.

As shown in FIGS. 1, 2, 5 and 6, an attaching means is secured to the transmitter 20 for removably attaching to the child.

Figure 3:
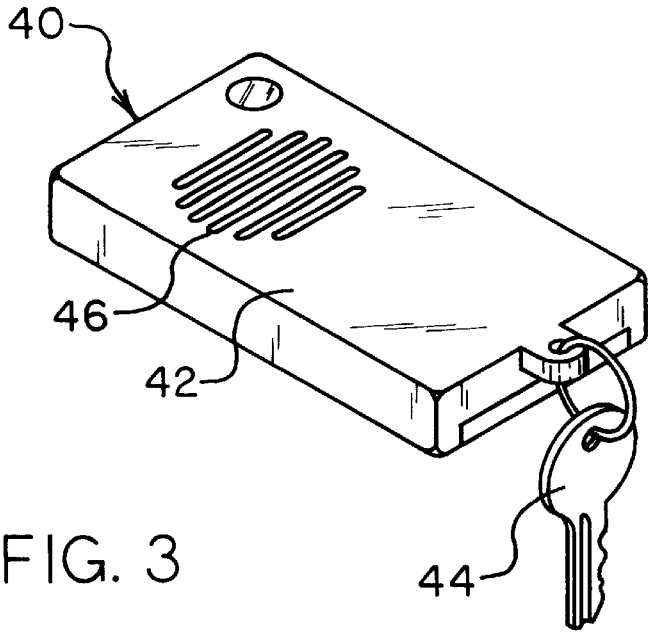
FIG. 3 is a upper side perspective view of a new child danger signaling device guardian's receiver according to the present invention.
Figure 4:
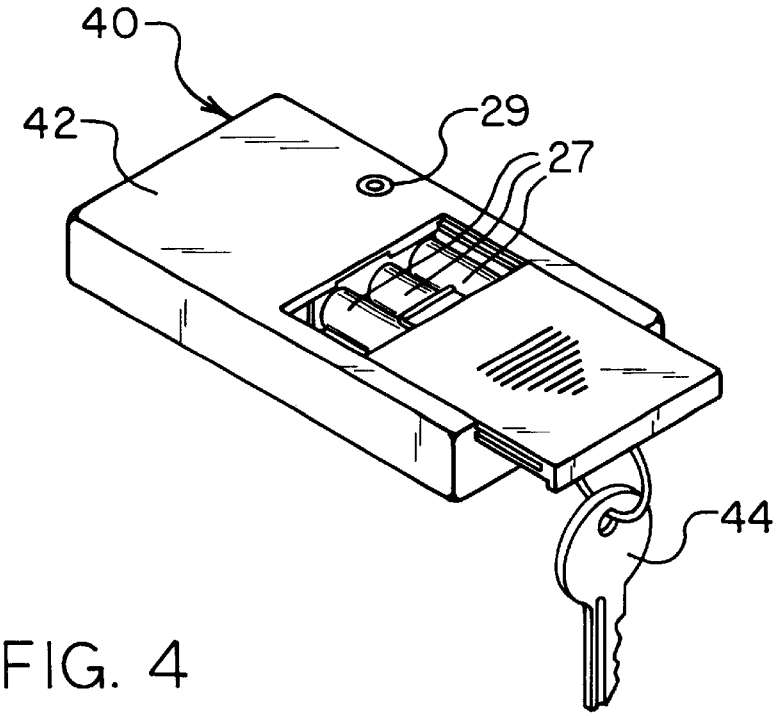
FIG. 4 is a lower perspective view of the thereof.

As best shown in FIG. 1, the transmitter 20 includes a lock 28 within thereof which receives a key 44 for deactivating the transmitter 20 upon receiving the key 44. The key 44 is removably attachable to the receiver 40 as shown in FIG. 3 and 4. In the transmitter unit 20, the lock may be moved by the key between either an on and an off position to activate or deactivate the transmitter. In the receiver unit 40, the key 44 may selectively move the lock between multiple positions to activate or deactivate various features of the receiver 40. Table 1 shows an arrangement of features activated when a key 44 is positioned in various positions on a receiver 40 having a lock 28 with four selectable positions with position 4 being the off or deactivated position for the entire receiver unit.

TABLE 1

| LOCK POSITION (x = activated) (– = not activated) 4 | 3 | 2 | 1 | FEATURE |
|---|---|---|---|---|
| – | x | x | x | when transmitter switch activated - receiver unit receives signal |
| – | – | – | x | receiver receivers a signal when transmitter moves beyond a certain distance from the receiver |
| – | – | x | x | transmitter switch activated alarm in transmitter activated |
| – | x | x | – | receiver switch activated - transmitter receives signal |
| – | – | – | x | receiver switch activated - alarm in transmitter activated |
| – | x | x | x | transmitter alarm not activated when transmitter moves beyond a certain distance from the receiver<br>receiver switch activated - alarm in receiver activated |
| – | x | x | x | low power indicator activated to indicate transmitter and receiver may not work properly |
| – | x | x | x | transmitter unit and receiver unit must be reset by key to deactivate alarm |

Figure 5:
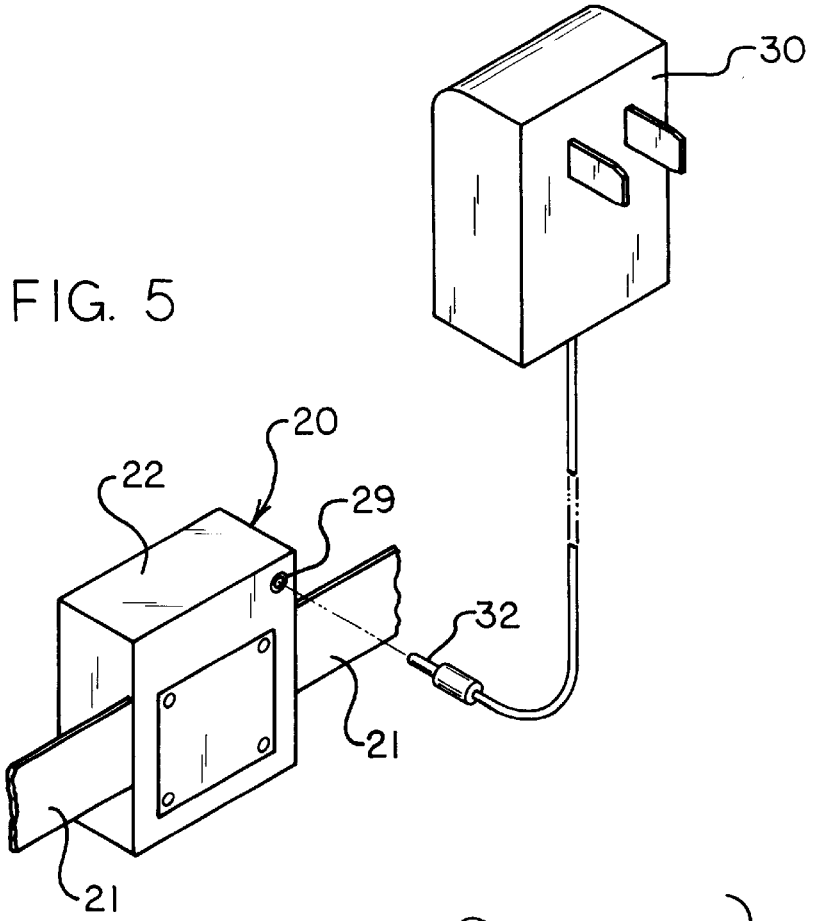
FIG. 5 is an upper perspective view of a second embodiment of a battery charger new child danger signaling device child's transmitter according to the present invention.

As shown in FIGS. 1 and 4 of the drawings, the transmitter 20 and the receiver 40 have rechargeable power sources 27 for providing electrical power to them. The transmitter 20 and the receiver 40 further have an electrical receptacle 29 electrically connected to the rechargeable power source 27 and secured within the swage encasement 22 and the rectangular encasement 42. As shown in FIG. 5 of the drawings, a recharging unit 30 has a male connector 32 for electrically connecting to the electrical receptacle 29. Optionally, the transmitter 20 and receiver 40 may include low power indicators 48 that can either be a light or a sound to notify a user that the power source of the transmitter 20 and the receiver 40 is close to being drained of power.

As shown in FIGS. 1, 2, 5 and 6 the attaching means either comprises a belt 21 for attaching to a waist of the child, a wrist band 23 for attaching to a wrist of the child, or a loop 25 for attaching to a neck of the child.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A child danger signaling device for transmitting a signal from a child in danger to a parent, said device comprising:

a transmitter having a substantially rectangular transmitter housing, said transmitter being for sending a signal;

a button positioned on said transmitter housing, said button being for activating the signal whereby the signal is sent upon depression of said button;

a receiver having a substantially rectangular receiver housing with an eyelet having an O-ring attached thereto, said receiver being for reception of said signal;

a receiver alarm within said receiver housing, said receiver alarm being for sounding a receiver alarm upon reception of said signal by said receiver, wherein the receiver sounds the alarm until the depression of an alarm reset button on the receiver housing;

a transmitter alarm within said transmitter housing, said transmitter alarm being for sounding a transmitter alarm upon depression of said button;

said transmitter having a lock, said lock positioned on a face of said transmitter housing, said lock being for deactivating said transmitter alarm, said lock further being for stopping said transmitter from sending said signal;

a key attached to said O-ring of said receiver housing, said key being for engaging said lock whereby said transmitter alarm and said signal are deactivated by said key being positioned within said lock and being subsequently moved;

attachment means being adapted for attaching said transmitter to the child;

a rechargeable transmitter power source within said transmitter housing;

a rechargeable receiver power source within said receiver housing;

a recharging unit, said recharging unit being for recharging said transmitter power source and said receiver power source; and wherein said attaching means includes one attachment means chosen from the group of attachment means consisting of a belt being adapted for attaching to a waist of the child, a wrist band being adapted for attaching to a wrist of the child, and a loop being adapted for attaching to a neck of the child;

wherein a receiver is positioned within the transmitter housing;

wherein a transmitter is positioned within the receiver housing.

* * * * *